US012345146B2

(12) United States Patent
Hunter et al.

(10) Patent No.: US 12,345,146 B2
(45) Date of Patent: Jul. 1, 2025

(54) METHODS FOR CONDUCTING A PRESSURE TEST TO MINIMIZE OVER PRESSURIZATION FOR A FLUID DISTRIBUTION SYSTEM

(71) Applicant: Halliburton Energy Services, Inc., Houston, TX (US)

(72) Inventors: Timothy Holiman Hunter, Duncan, OK (US); Shaun Kyle Pyka, Houston, TX (US); Bruce Carl Lucas, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/235,635

(22) Filed: Aug. 18, 2023

(65) Prior Publication Data

US 2025/0059869 A1 Feb. 20, 2025

(51) Int. Cl.
*E21B 43/26* (2006.01)
*E21B 49/00* (2006.01)

(52) U.S. Cl.
CPC ..... *E21B 43/2607* (2020.05); *E21B 49/008* (2013.01)

(58) Field of Classification Search
CPC ..... E21B 49/08; E21B 43/2607
See application file for complete search history.

(56) References Cited

U.S. PATENT DOCUMENTS

| | | | | |
|---|---|---|---|---|
| 2,390,204 | A * | 12/1945 | Curtis | F04D 9/042 417/199.2 |
| 5,092,162 | A | 3/1992 | Self | |
| 5,623,910 | A | 4/1997 | Riggle | |
| 7,234,529 | B2 | 6/2007 | Surjaatmadja | |
| 8,230,875 | B2 | 7/2012 | Norman | |
| 11,237,076 | B2 | 2/2022 | Mazrooee et al. | |
| 11,293,227 | B2 | 4/2022 | Brunet | |
| 2012/0255734 | A1 * | 10/2012 | Coli | F04B 47/02 166/305.1 |
| 2013/0092261 | A1 | 4/2013 | Andersson | |
| 2018/0244148 | A1 * | 8/2018 | Arras | F02M 25/0836 |
| 2021/0063271 | A1 | 3/2021 | Mazrooee et al. | |

OTHER PUBLICATIONS

Filing Receipt, for U.S. Appl. No. 18/136,453, entitled "Electrically Powered Pumping Unit With Removable Pumpmodules," filed Apr. 19, 2023, 50 pages.

J. Koto, Application of Subsea Tree Deep Water, Second Edition. Oct. 2017, Ocean & Aerospace Research Institute, Indonesia. pp. 2-68.

* cited by examiner

*Primary Examiner* — D. Andrews
(74) *Attorney, Agent, or Firm* — Conley Rose, P.C.; Rodney B. Carroll

(57) ABSTRACT

A method for minimizing over pressurization during a pressure test of a fluid distribution system comprises a plurality of pumping units in fluid communication with a wellhead via a manifold. The method comprises pressurizing the fluid distribution system with a fluid using an initial number of pumping units to an initial predetermined pressure, and further pressurizing the fluid distribution system with the fluid using a final number of pumping units to a final predetermined pressure. The final number of pumping units is less than the initial number of pumping units.

20 Claims, 5 Drawing Sheets

METHODS FOR CONDUCTING A PRESSURE TEST TO MINIMIZE OVER PRESSURIZATION FOR A FLUID DISTRIBUTION SYSTEM

FIELD

This application relates to methods of conducting a pressure test for a fluid distribution system. More specifically, this application relates to methods of conducting a pressure test to minimize over pressurization for a fluid distribution system for wellbore operations.

BACKGROUND

At drilling platforms, several phases of drilling operations are typically conducted, such as drilling, cementing, treating, producing, and secondarily treating, such as formation fracturing. Well stimulation, including fracturing, can be utilized by the oil and gas industry to increase the transfer of hydrocarbon resources from a reservoir formation to a wellbore. Pressurized fracturing fluid is introduced into a wellbore to generate fractures downhole in the reservoir formation. Typically, these pressures exceed the fracture gradient of the subterranean formation, and thus, place stress on the piping and equipment subject to these pressures.

Periodically, in any of these phases, the piping and equipment can be subject to pressure testing to determine if there are any leaks. Due to the particularly high pressures utilized during fracturing, testing can be conducted to ensure the reliability of the equipment and for the protection of personnel.

During a pressure test, pumps are used to pressurize a fluid to a target pressure to check for leaks in piping and equipment. In some instances, the pumps, after deactivating, continue to rotate and/or reciprocate and pressurize past the targeted test pressure, which may over pressure the piping and equipment. Such an over pressure can result in damage, or at a minimum, reinspection of the all piping and equipment subject to the overpressure to ensure equipment integrity. Moreover, some pumps may not have a clutch or similar device to decouple the motor from a shaft and rotor to operate the pumps in neutral prior to reaching the target pressure. After reaching the final pressure and discontinuing operation of the pumps, the fluid in the piping can expand and apply a force, by the now unpumped fluid expanding outward, back into the rotor, shaft and motor of the pump. This fluid backlash against the pumps can result in damage to the pumps' drive shaft. Thus, there is a need for a method with some pumps to minimize the overpressure and backlash during pressure testing.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
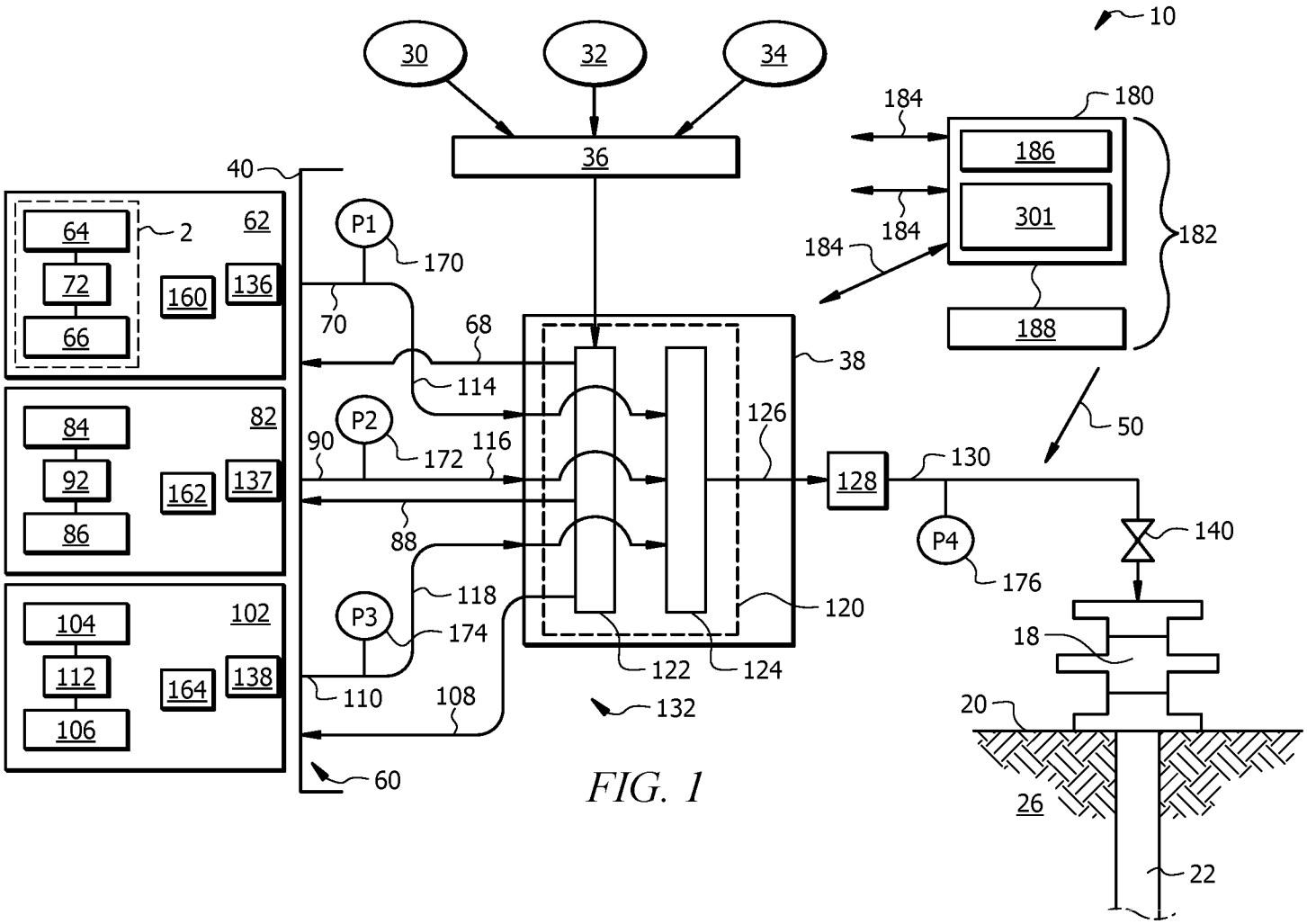
FIG. 1 is a schematic block diagram of an embodiment of a wellbore operational environment for conducting a pressure test.

In the following detailed description of the illustrative embodiments, reference is made to the accompanying drawings that form a part hereof. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the term "fluid path" can be a path formed by a wellbore and can be used for the production of fluids, such as hydrocarbons and water, or be used for the injection of fluids, such as fracturing fluids, and may be used interchangeably with "line" or "pipe" with respect to the drawings.

As used herein, the term "pumping and piping manifold" can mean a zone of piping and equipment optionally capable of forming a closed system subject to pressurized fluid and pressure testing. This zone can include the discharges from one or more pumps, one or more manifolds, and piping to one or more valves isolating one or more respective wellheads. In the field, this zone may be referred to a "frac iron" or "frac iron configuration" subject to high pressures during operations. Although the term "iron" is utilized to described the material used to manufacture much of the equipment and piping, the equipment may be made from iron or any other suitable material depending on the type of operation.

As used herein, the term "fluid" may be a liquid or a gas, and includes an aqueous fluid that can be used during a pressure test.

As used herein, the terms "initial", "intermediate", and "final" may be used to distinguish pressure or number of pumps. As an example, an initial number of pumps may be greater than an intermediate number of pumps, and an intermediate number of pumps may be greater than a final number of pumps. As a further example, an initial pressure or predetermined pressure may be less than an intermediate pressure or predetermined pressure, and an intermediate pressure or predetermined pressure may be less than a final pressure or final predetermined pressure. In some instances, the terms "first" and "second" may correspond to "initial" or "intermediate" and "final"; "initial" and "intermediate" or "final"; or "initial" and "final".

As used herein, the term "system" can include an oilfield platform including piping, one or more manifolds, equipment, one or more fluids, one or more valves, one or more sensors, and a computer system for conducting one or more wellbore operations.

As used herein, the term "fluid distribution system" can be a group of interrelated elements for distributing a fluid and can include one or more fluid sources, one or more lines, pipes, pumps, manifolds, and valves.

As used herein, the term "computer system" can be a group of interrelated elements acting to a set of rules and include one or more processors, memories, network interfaces, controllers, sensors, and buses for controlling or automating one or more wellbore operations.

As used herein, the term "closed system" can mean an enclosed space permitting fluid entry, but not its exit except for intermittent purging of some liquids, to allow an increase in pressure, and can be accomplished for piping and equipment by, e.g., closing a valve, to, e.g., a wellbore.

As used herein, the term "pumping unit" can include at least one pump and motor. In some instances, two or more pumps can be powered by a single motor. Generally, a pumping unit has a single motor.

As used herein, the term "network" can include lines or pipes extending to and from a manifold.

As used herein, the term "manifold" can be interconnected lines or pipes for distributing a fluid to different locations.

As used herein, the terms "pipe" and "line" may be used interchangeably.

As used herein, the term "pressure cycle" can mean a continuous, increasing pressure from an initial pressure to a final pressure for a pressure test with a final number of at least one pump or pumping unit. The at least one pump or pumping unit of the final number operates continuously and does not shutdown during the pressure cycle.

As used herein, the term "and/or" can mean one or more of items in any combination in a list, such as "A and/or B" means "A, B, or the combination of A and B".

It is to be understood that "subterranean formation" encompasses both areas below exposed earth and areas below earth covered by water such as ocean or fresh water.

The present disclosure relates to methods of minimizing overpressures while conducting pressure tests, particularly for piping and equipment used for oil well operations. In some embodiments, the pressure is defined by an inflection point of pressure versus time after pressurizing. In some embodiments, the present disclosure includes a system for conducting a pressure test, optionally with a computer system for controlling and/or automating the test. Generally, the methods and systems provided herein allow the pressure testing of piping and equipment while minimizing damage to the pumps and piping subject to pressure test conditions.

In some embodiments, a method of conducting a pressure test can include isolating a pumping and piping manifold to form a closed system by closing a valve upstream from a wellhead. The pumping and piping manifold can include a plurality of pumping units in fluid communication with the wellhead via a manifold. The method can include pressurizing the closed system with a fluid using an initial number of pumping units to an initial predetermined pressure, and further pressurizing the closed system with the fluid using a final number of pumping units to a final predetermined pressure. Often, the final predetermined pressure can be greater than the initial predetermined pressure, and the final number of pumping units can less than the initial number of pumping units.

In some embodiments, a method for minimizing over pressurization during a pressure test of a fluid distribution system can include a plurality of pumping units in fluid communication with a wellhead via a manifold. The method can include pressurizing the fluid distribution system with a fluid using an initial number of pumping units to an initial predetermined pressure, optionally pressurizing with an intermediate number of pumping units to an intermediate pressure, and further pressurizing the fluid distribution system with the fluid using a final number of pumping units to a final predetermined pressure. Generally, the final predetermined pressure is greater than the initial predetermined pressure, and the final number of pumping units is less than the initial number of pumping units. Usually, the intermediate pressure is greater than the initial predetermined pressure and less than the final predetermined pressure, and the intermediate number of pumping units is less than the initial number of pumping units and greater than the final number of pumping units. In some embodiments, the intermediate group of pumping units can be selected from and less than the initial group of pumping units, and the final group of pumping units can be selected from and less than the intermediate group of pumping units.

During the pressure test, the fluid distribution system can be evaluated by monitoring for leakage. After reaching the final predetermined pressure, the final predetermined pressure can be held to monitor the fluid distribution system for leakage.

In some embodiments, the initial number of pumping units can be at least two, three, four, five, six, seven, eight, nine, or ten, and the final number of pumping units can be no more than nine, eight, seven, six, five, four, three, two, or one, preferably one. In some embodiments, the initial number of pumping units is three, the intermediate number of pumping units is two, and the final number of pumping units is one.

Each of the plurality of pumping units can include a motor and at least one pump, and in some embodiments the motor may include an electric motor. A final pumping unit of the final number of pumping units may be diesel-powered. The plurality of pumping units and the manifold can be located above a surface.

In certain embodiments, the at least one pumping unit can operate continuously until a maximum pressure is reached, or the final number of pumping units, such as one, can be operated continuously during the pressure test until the final pressure is obtained. In some embodiments, a single pump of the single final pumping unit can be operated continuously during the pressure test until the final pressure is obtained. In some embodiments, the final number of pumping units can be operated discontinuously by deactivating and reactivating the final number of pumping units during the pressure test until the final pressure can be obtained. Sometimes, the time between changing between the initial number of pumping units and the final number of pumping units is greater than about 5, about 10, about 20, about 30, about 40, about 50, about 60, about 120, about 300, or even about 600 seconds.

In some embodiments, the plurality of pumping units and the manifold can be comprised in a pumping and piping manifold, and a pressure loss based on one or more measured pressures in the pumping and piping manifold may be indicative of a leak. In some embodiments, a pressure test is conducted in a single pressure cycle, i.e., continuously, on a closed system by isolating the wellhead from a pumping and piping manifold. In this manner, fluid does not flow into the wellbore and out into the formation and pressure can build in the closed system.

In some embodiments, at least the initial predetermined pressure for a first evaluation time period can be maintained and monitored for one or more measured pressures within the fluid distribution system during the first evaluation time period to identify a leak associated with a decrease in pressure. The final predetermined pressure for a second evaluation time period can be maintained and monitored for one or more measured pressures within the fluid distribution system during the second evaluation time period to identify a leak associated with a decrease in pressure.

In some embodiments, a reduction in a number of pumping units can minimize flow and kinetic energy exerted on the pumping units removed from the initial number to obtain the intermediate number of pumping units. Particularly, when pump units are shutdown during the pressure test, the pressurized fluid can relax and provide a "force backlash" against the rotors and driveshafts of the individual pumps. Generally, the higher the pressure, the greater the backlash. By reducing the number of pumps in operation, the shutdown pumps can optionally be isolated by, e.g., closing a valve, and the shutdown pumps are exposed to lower pressures, and not the highest test pressure, reducing the risk of damage to the isolated, shutdown pumps. In some embodiments, only a single pumping unit or even a single pump is subject to the highest pressure when that pump is shutdown at the final predetermined pressure. This minimizes risk of damage to the other pumps previously shutdown.

In some embodiments, a final number of pumping units can be identified as recently subjected to maintenance to improve mechanical reliability prior to the pressure test. Particularly, if some of the pumps used in the tests have been recently subject to mechanical maintenance, these pumps can be used in the final number of pumping units to ensure proper seals of the recently maintained pump at the final test pressure (e.g., checking for proper sealing such as packing seal around the plunger, discharge valve seal, suction valve seal, access port seals, etc.). In this manner, pumping units that have been subject to maintenance would be exposed to the greatest "backlash" pressure at the end of the pressure test, such as the final predetermined pressure. As such, the recently maintained/overhauled pump would be exposed to the final test pressure to ensure its proper operation. In an embodiment, a recently maintained or overhauled pump is one that has had one or more sealing surfaces (e.g., packing seal around the plunger, discharge valve seal, suction valve seal, access port seals, etc.) maintained or replaced and has not previously been subjected to the final test pressure (e.g., has not been pressure tested since the maintenance/overhaul service).

In some embodiments, at least one pumping unit may be different from other pumping units of the initial number of pumping units. This difference can be a different pump structure, such as having a clutch allowing isolation of a driveshaft from a fluid backlash, or a different power source, such as electric or diesel. Thus, at least one pumping unit, such as a diesel-powered motor having a clutch, may be operated until the final predetermined pressure is reached. In this manner, the final number of pumps or pumping units can be of type particularly suited for resisting damage from a force backlash when the final number of pumps or pumping units are shutdown at the final predetermined pressure.

In some embodiments, an initial predetermined pressure can be at least about 1,000 psi, about 2,000 psi, about 3,000 psi, about 4,000 psi, about 5,000 psi, about 6000 psi, about 7,000 psi, or about 8,000 psi. In some embodiments, an initial predetermined pressure can be no more than about 1,000 psi, about 2,000 psi, about 3,000 psi, about 4,000 psi, about 5,000 psi, about 6000 psi, about 7,000 psi, or about 8,000 psi. In some embodiments, the initial predetermined pressure is about 3,000 psi to about 5,000 psi, about 3,500 psi to about 4,500 psi, or about 3,800 psi to about 4,200 psi.

In some embodiments, a final predetermined pressure is at least about 8,000 psi, about 10,000 psi, about 12,000 psi, about 14,000 psi, about 15,000 psi, about 20,000 psi, or about 25,000 psi. In some embodiments, a final predetermined pressure is no more than about 10,000 psi, about 12,000 psi, about 14,000 psi, about 15,000 psi, about 20,000 psi, or about 25,000 psi, or about 30,000 psi. In some embodiments, a final predetermined pressure is about 10,000 psi to about 14,000 psi, about 11,000 psi to about 13,000 psi, or about 11,500 psi to about 12,500 psi.

In some embodiments, a method for detecting a leak in a pumping and piping manifold for at least one wellbore operation can include performing a pressure cycle on the pumping and piping manifold. The pressure cycle can include: pressurizing the pumping and piping manifold with a fluid to generate a predetermined pressure within the pumping and piping manifold, monitoring one or more measured pressures within the pumping and piping manifold at one or more times during an evaluation time period beginning once a predetermined pressure with the pumping and piping manifold has been reached, further increasing pressurization of the pumping and piping manifold to observe an inflection point of pressure versus time after pressurizing, and determining whether a pressure loss in the pumping and piping manifold indicates detection of a leak based on the one or more measured pressures.

In some embodiments, the inflection point can be observed by reducing from a first number of pumping units to a lesser second number of pumping units, and can further include observing a plurality of inflection points as the number of pumping units may be reduced.

In some embodiments, a system can include a pumping and piping manifold including a piping network forming one or more flow paths for containing and delivering a fluid to a wellhead, a plurality of pumping units comprised in the pumping and piping manifold and the plurality of pumping units configured to provide the fluid, one or more sensors configured to monitor one or more fluid pressures within the pumping and piping manifold, and a controller configured to automatically control an operation of the plurality of pumping units and to perform a single pressure testing cycle on the pumping and piping manifold. Generally, a pressure testing cycle can include pressurizing the pumping and piping manifold to an initial predetermined pressure within the pumping and piping manifold using two or more of the plurality of pumping units configured in a predefined pump configuration constituting a first number of pumping units, and further pressurizing the pumping and piping manifold using a second number of pumping units less than the first number of pumping units to a maximum pressure with at least one pumping unit of the first number of pumping units operating continuously to the maximum pressure, monitoring, based on output signal from the one or more sensors. One or more pressure levels within the pumping and piping manifold at one or more times during an evaluation time period beginning once the predetermined pressure within the pumping and piping manifold has been reached can be measured, including monitoring a bleed off pressure within the pumping and piping manifold over the evaluation time period as a slope of a pressure curve, and determining whether a pressure loss in the pumping and piping manifold exceeds a maximum bleed off value.

In some embodiments, the monitoring can continue until the maximum pressure is reached. Generally, the pumping and piping manifold can include the plurality of pumping units in fluid communication with the wellhead via a manifold and one or more lines. At least a portion of the pumping and piping manifold may be located above a surface. In some embodiments, an oil and gas platform can include the system, as described above.

In some embodiments, a method of pressure testing a manifold in fluid communication with a wellhead, can include starting pumping of a fluid by first number of pumping units in fluid communication with the manifold to pressurize the manifold to a first predetermined pressure; upon reaching the first predetermined pressure, halting pumping of fluid by one or more of the first number of pumping unit; continuing pumping of fluid with a second number of pumping units that is less than the first number of pumping units (e.g., a single pump driven by an electric motor) to pressurize the manifold to a second predetermined pressure. Upon reaching the second predetermined pressure, pumping of fluid by the second number of pumping units can be halted. Generally, the step of continuing pumping of fluid can further include as pressure in the piping manifold approaches the second predetermined pressure, e.g., is within about 1000 psi, about 900 psi, about 800 psi, about 700 psi, about 600 psi, 500 psi, about 400 psi, about 300 psi, about 200 psi, about 100 psi, about 50 psi, about 10 psi, or about 1 psi thereof, reducing a pumping rate of the second number of pumps, e.g., by reducing a variable drive electric motor driving a pump. In certain embodiments, the pressure in the manifold does not exceed the second predetermined pressure by, e.g., more than about 1000 psi, about 500 psi, about 100 psi, about 50 psi, about 40 psi, about 30 psi, about 20 psi, about 10 psi, about 9 psi, about 8 psi, about 7 psi, about 6 psi, about 5 psi, about 4 psi, about 3 psi, about 2 psi, about 1 psi, about 0.5 psi, about 0.1 psi, or about 0 psi, before the halting pumping of fluid by the second number of pumps to minimize or prevent overshoot of the second predetermined pressure, which may be associated with an over-pressurization threshold of the manifold and equipment in fluid communication with the manifold.

Referring to FIG. 1, a schematic block diagram of an embodiment of a wellbore operational environment for conducting a pressure test is depicted. A system 10 can include a blender 36, a trailer 38 supporting a manifold 120, a pumping and piping manifold 40, a wellhead 18, and a computer system 180 for employing apparatus, methods, and systems in accordance with embodiments disclosed herein. In some embodiments, the system 10 can be or include an oil and gas platform 10 or can include a fluid distribution system 10.

The system 10 can optionally be configured for automatic pressure testing, although the pressure testing can be tested manually. As depicted FIG. 1, a wellbore 22 capped by a wellhead 18 can extend from a surface 20, such as the earth's surface, and downward into a subterranean formation 26. The wellbore 22 may include a casing that encloses at least some of the wellbore 22 extending from surface 20 into the subterranean formation 26 to some depth extending away from a top opening of the wellbore 22 at the surface 20. A choke valve comprising one or more connections and/or shut-off valves may be positioned at the top opening, and arranged to couple to the casing and thus seal off the borehole relative to the piping and equipment above surface 20. In some embodiments, a valve 140 may be used to isolate the wellbore 20, and may operated manually or automatically. During normal operations of introducing fluid, such as fracturing fluids, into the subterranean formation 26, fluid can flow past the open valve 140. During pressure testing, the valve 140 is closed stopping fluid flow past the wellhead 18 into the subterranean formation 26. Pressure testing may be performed in order to determine if leaks exist in the system 10, and/or to confirm that the system 10 is adequately configured to withstand the maximum fluid pressures that equipment and piping may be exposed during a fracturing process.

The system 10 can include a pumping and piping manifold 40 subject to the high pressures during fracturing operations, thus is subjected to pressure testing to ensure viability of piping and equipment. The pumping and piping manifold 40 can include the discharges 70, 90, and 110 from respective pumping units discussed hereinafter, a manifold 120, and piping to the valve 140. The manifold 120 can include a low pressure suction manifold 122 and a high pressure suction manifold 124 supported by a trailer 38. The manifold 120 can have a manifold outlet line 126, which in turn communicates with at least one line or pipe 130 with the wellhead 18.

Figure 2:
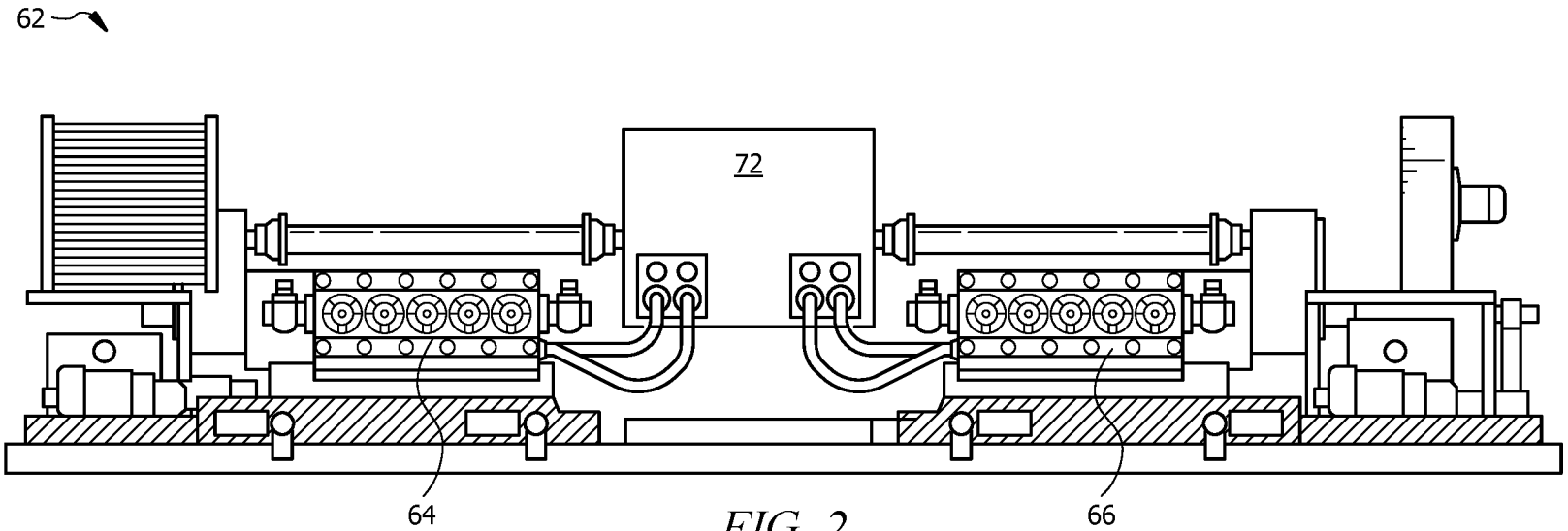
FIG. 2 is a schematic of an embodiment of a pumping unit.

The system 10 can further include a plurality of pumping units 60, such as a first pumping unit 62, a second pumping unit 82, and a third pumping unit 102. Referring to FIGS. 1-2, the first pumping unit 62 can include at least one pump, such as a first pump 64 and a second pump 66 powered by a motor 72, a check valve 136, and a controller 160. Although two pumps 64 and 66 are depicted, any suitable number of pumps, such as one, two, three, four, or more may be included in a first pumping unit 62. Similarly, a second pumping unit 82 can include pumps 84 and 86, a motor 92, a check valve 137, and a controller 162, and a third pumping unit 102 can include pumps 104 and 106, a motor 112, a check valve 138, and a controller 164. Although a single check valve is shown for each pumping unit 62, 82, and 102, in some embodiments each pump of the respective pumping unit can have a check valve at or downstream of each pump's discharge. The second pumping unit 82 and third pumping unit 102 can include any suitable number of pumps, similar to the first pumping unit 62. A network 132 of one or more pipes, including suction lines 68, 88, and 108 and discharge lines 114, 116, and 118 can communicate the manifold 120 with the plurality of pumps 60.

The system 10 can also include a computer system 180 for control and/or automation. The computer system 180 may also include one or more sets of communication links 184 that allow computer system 180 to communicate with other devices included within the system 10. In some embodiments, the computer system 180 can include a display 186, one or more input and/or output devices 188, a processor 301, and one or more communication links 184, in this exemplary embodiment three communication links 184. The display 186, one or more input and/or output devices 188, and the processor 301 can be comprised in a controller 182. The system 10 can also include one or more sensors, such as pressure sensors, 170, 172, 174, and 176, and a control valve 128 downstream of the manifold 120. Each of pressure sensors 170, 172, 174, and 176, may be configured to provide an output, such as an electrical output signal, that is indicative of the pressure level that is present in the respective pump discharges 70, 90, and 110 or the one or more pipes 130 to which the sensor 176 is coupled. Another embodiment of a computer system 180 is discussed below.

The system 10 may further include sources for fluids and additives for wellbore operations. In some embodiments, the system 10 can include a sand and/or proppant source 30, a pressure test fluid source 32, and one or more additions source 34. The pressure test fluid source 32 can be an aqueous fluid, such as fresh water, surface water, ground water, produced water, salt water, sea water, brine (e.g., underground natural brine, formulated brine, etc.), and combinations thereof. The pressure test fluid source 32 can be provided to the manifold 120. The manifold 120, in turn, can communicate with the plurality of pumping units 60 via suction lines 68, 88, and 108 to respective pumping units 62, 82, and 102.

Figure 3:
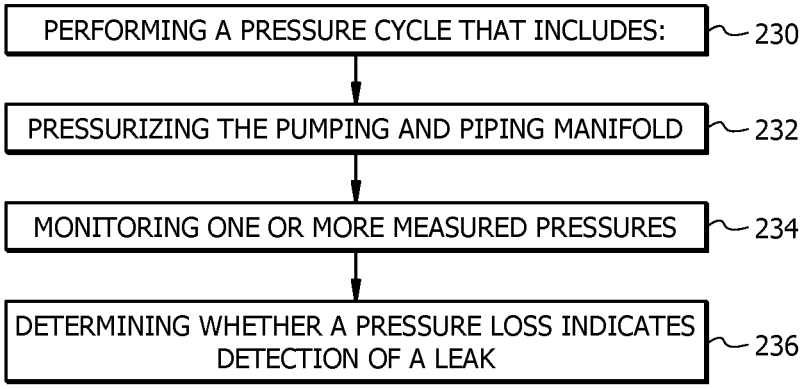
FIG. 3 is a flowchart of an embodiment of a method of conducting a pressure test.

Referring to FIG. 3, a pressure test can include performing a pressure cycle 230. The pressure cycle 230 can include pressurizing the pumping and piping manifold 232, monitoring one or more measured pressures 234, and determining whether a pressure loss is indicative of a leak 236. Generally, the pressure test is conducted on the pumping and piping manifold 40 that includes discharges 70, 90, and 100, the discharge lines 114, 116, and 118, manifold 120, the manifold outlet line 126, and the one or more lines 130 to the closed valve 140.

Figure 4:
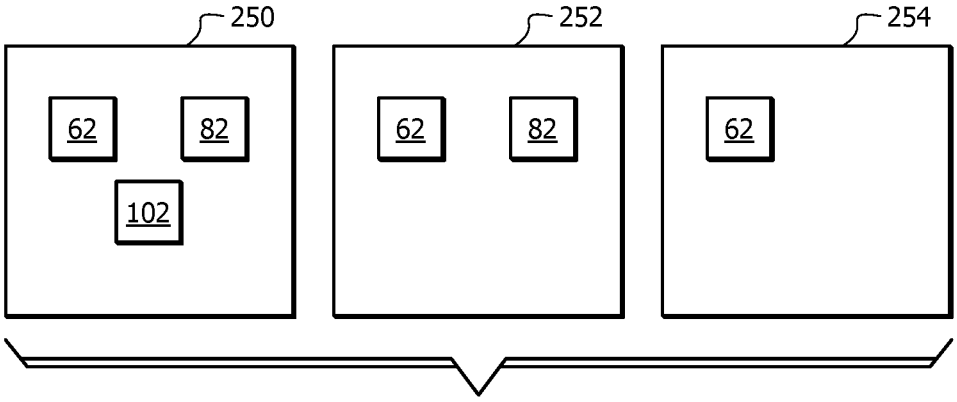
FIG. 4 is a block diagram of an embodiment of a method of conducting a pressure test with different number of pumping units.
Figure 5:
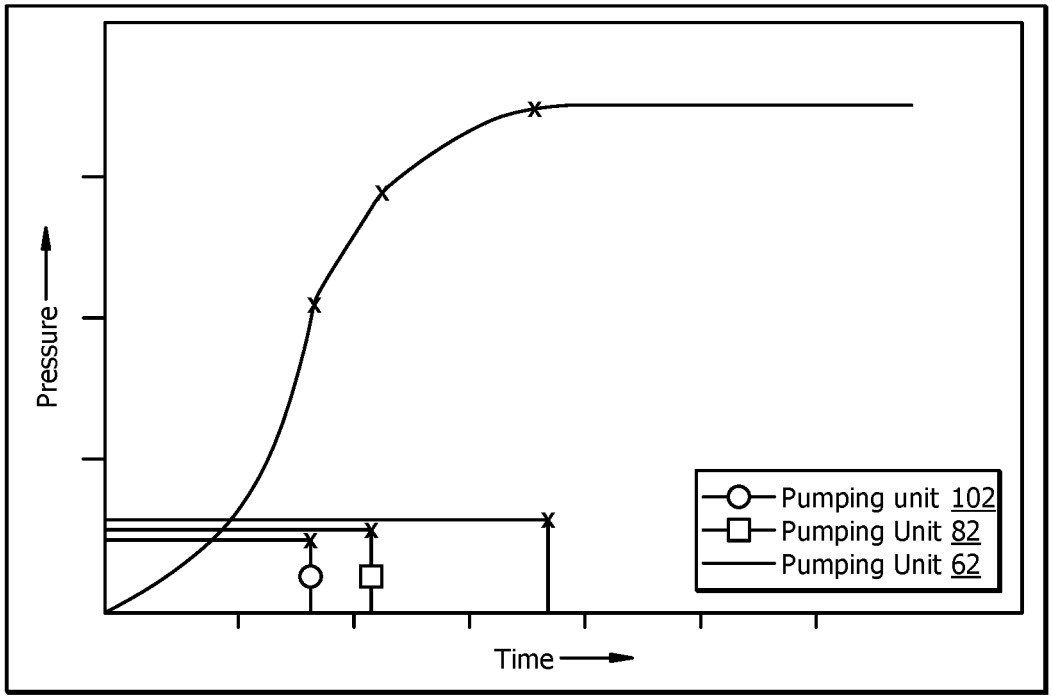
FIG. 5 is a graphical depiction of an embodiment showing different numbers of pumping units operating during a pressure test.

Referring to FIGS. 4-5, in some embodiments, the pressure test can begin with an initial or a first number of pumping units 250 as depicted in FIG. 4. The initial number of pumping units 250 can be a first pumping unit 62, a second pumping unit 82, and a third pumping unit 102. Referring to FIG. 5, initially all pumping units 62, 82, and 102 are operating to pressurize the pumping and piping manifold 40 at an initial or first predetermined pressure. After reaching an intermediate or a second predetermined pressure, the third pumping unit 102 is shutdown. In this matter, the third pumping unit 102 is only subject to a fluid backlash at the lower, second predetermined pressure. The remaining pumping units 62 and 82 remain operable to pressure the system 10. That being done, the pumping units 62 and 82 continue to raise the raise the pressure to another intermediate or a third predetermined pressure. At that time, the pumping unit 82 is shutdown. Again, although the third predetermined pressure is greater than the second predetermined pressure, the pumping unit 82 is subject to less force from a fluid backlash as compared to the final predetermined pressure. The remaining pumping unit 62 can continue operation until the fourth or final predetermined pressure. At that time, the remaining pumping unit 62 can be shutdown and the pressure can stabilize or remain flat, as depicted in FIG. 5.

Using a final number of pumping units, which is a lesser number than the initial number of pumping units, minimizes the flow rate and kinetic energy of the system permitting greater control to reach, without over pressurizing, the final predetermined pressure, thereby minimizing over pressure. Also, the greatest fluid backlash at the final predetermined pressure is only applicable to the final number of pumps. Pumps shutdown prior to the final predetermined pressure receive less of a force backlash as these pumps are shutdown at pressures less than the final predetermined pressure.

Referring to FIG. 5, at the time of shutting down pumping units 102 and 82, the plot of pressure versus time can exhibit two inflection points as pumping units 102 and 82 are shutdown. Although two infection points are depicted, any number of inflection points may be exhibiting corresponding to the number of pumping units being shut down. Although the term "pumping unit" is being used, it should be understood that each pumping unit may only have a single pump in operation in some embodiments.

Figure 6:
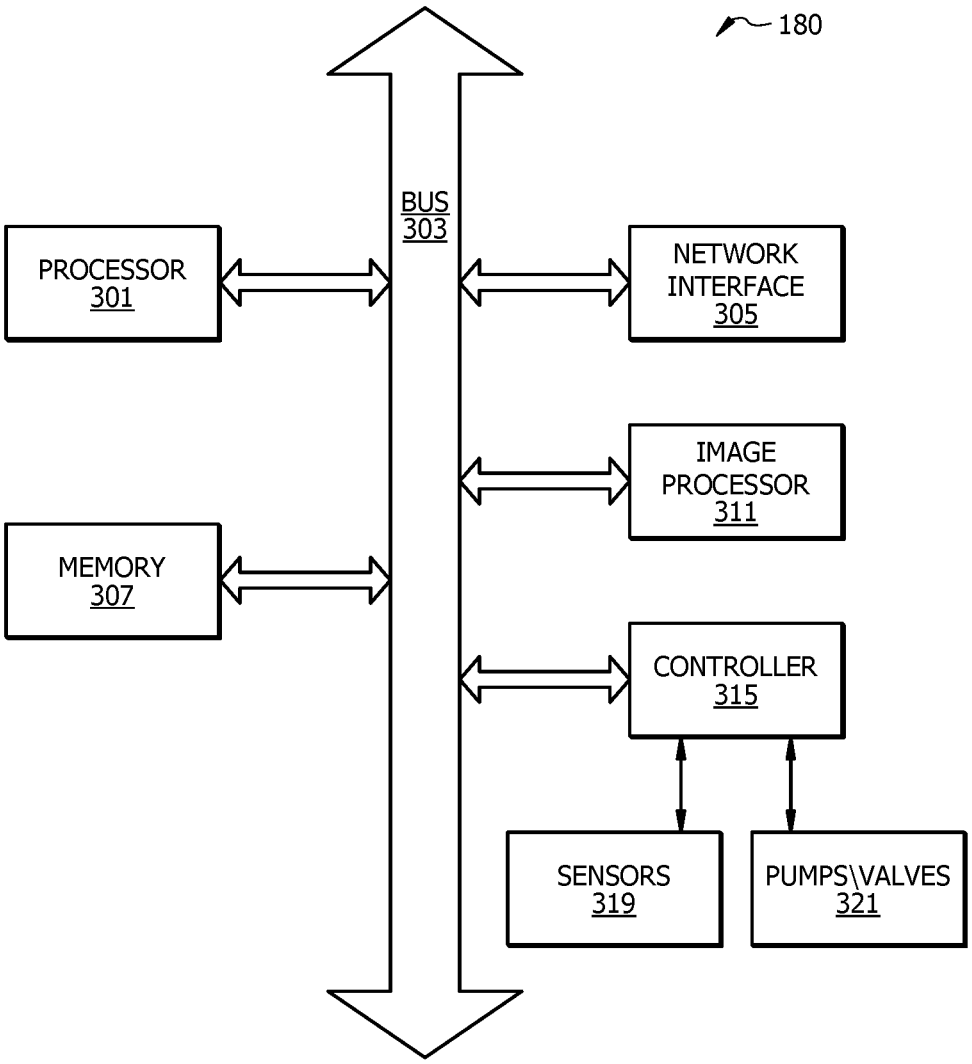
FIG. 6 is a block diagram of an embodiment of a computer system for implementing a pressure test.

Referring to FIG. 6, in some embodiments the computing system 180 may be a general-purpose computer, and includes a processor 301 (possibly including multiple processors, multiple cores, multiple nodes, and/or implementing multi-threading, etc.). The computer can include a memory 307. The memory 307 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the possible realizations of machine-readable media. The computer system also includes a bus 303 (e.g., PCI, ISA, PCI-Express, HyperTransport® bus, InfiniBand® bus, NuBus, etc.) and a network interface 305 (e.g., a Fiber Channel interface, an Ethernet interface, an internet small computer system interface, SONET interface, wireless interface, etc.).

The computer may also include an image processor 311 and a controller 315. The controller 315 can control the different operations that can occur in the response inputs from the sensors 319 and/or calculations based on inputs from the sensors 319 (such as the sensors 170, 172, 174, and 176 of the system 10, as depicted in FIG. 1) using any of the techniques described herein, and any equivalents thereof, to provide outputs to control the pumps/valves 321. For example, the controller 315 can communicate instructions to the appropriate equipment, devices, etc. to alter control number and/or the horsepower setting use by pumps, (such as the pumps 64, 66, 84, 86, 104, and 106, as depicted in FIG. 1) and/or to set and control valves (such as the valve 128 as illustrated in FIG. 1) that may be utilized in an automatic pressure testing procedure. Any one of the previously described functionalities may be partially (or entirely) implemented in hardware and/or on the processor 301. For example, the functionality may be implemented with an application specific integrated circuit, in logic implemented in the processor 301, in a co-processor on a peripheral device or card, etc. Further, realizations may include fewer or additional components not illustrated in FIG. 6 (e.g., video cards, audio cards, additional network interfaces, peripheral devices, etc.). As illustrated in FIG. 6, the processor 301 and the network interface 305 are coupled to the bus 303. Although illustrated as also being coupled to the bus 303, the memory 307 may be coupled to the processor 301 only, or both the processor 301 and bus 303.

The controller 315 may be coupled to the sensors 319 and to the pumps/valves 321 using any type of wired or wireless connection(s), and may receive data, such as measurement data, obtained by the sensors 319 or provided by the pumps/valves 321. The sensors 319 may include any of the sensors associated with a wellbore environment, including but not limited to the pressure sensors configured to output signals indicative of pressure level within a pumping and piping manifold 40. Measurement data may include any of the data associated with an automatic pressure testing procedure. The controller 315 may include circuitry, such as analog-to-digital (A/D) converters and buffers that allow the controller 315 to receive electrical signals directly from one or more of the sensors 319.

The processor 301 may be configured to execute instruction that provide control over an automatic pressure testing procedure as described in this disclosure, and any equivalents thereof. For example, the processor 301 may control operations of one or more pumps being utilized to pressurize the pumping and piping manifold 40 as part of an automatic pressure testing procedure. Control of pumps may include determining a set of predefined pump configurations, wherein a particular one of the predefined pump configurations are assigned to be used during each of a plurality of pressure testing cycles, and providing output signal, for example to controller(s) located at the pumps, to configure and control the operations of the pumps at each pressure testing cycle according to the predefined pump configuration that is to be applied to that particular pressure testing cycle. The processor 301 may also be configured to receive output signals generated by the sensors 319, to process the signals to generate pressure level data, and to utilize that pressure level data to determine if a leak or leaks have been detected as a result of the pressure testing procedure. The processor 301 may also be configured to support any interaction between a system user and the computer system 180, including generating for display output information related to the results obtained from running an automatic pressure testing procedure on the pumping and piping manifold 40, and receive and process inputs provide by a system user to the computer system 180, for example regarding how to proceed with the automatic pressure testing procedure when leaks are detected by the procedure.

With respect to the computing system 180, the basic features here may easily be substituted for improved hardware or firmware arrangements as they are developed. In some examples, the memory 307 includes non-volatile memory and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 180 or as a general purpose computer, some embodiments can be any type of device or apparatus to perform operations described herein.

Automatic pressure testing procedures performed by the system 10 may be controlled at least in part by the computer system 180. The computer system 180 may include one or more processors, which for simplicity are hereinafter referred to as the processor 301. The processor 301 is not limited to any particular type of processor, and may include multiple processors and/or different types of processors, such as a general processor and an image processor. The processor 301 may be coupled to memory, (such as the memory 307 as shown in FIG. 6), that stores programs, algorithms, and parameter values that the processor 301 operates on to perform the automatic pressure testing procedures performed for a pressure test. The computer system 180 may include the display 186, which may be an interactive display such as a touch screen. The computer system 180 may including one or more I/O devices 188, such as but not limited to a computer keyboard, a computer mouse, or other known devices that allow a system operator, such as a technician or engineer, to interact with the computer system 180.

The computer system 180 may also include the one or more sets of communication links 184. For example, the communication links 184 may be configured to communicatively couple the computer system 180 to the pumps 64, 66, 84, 86, 104, and 106, for example to communicate with the controllers 160, 162, and 164 located at the pumping units 62, 82, and 102. The communication link(s) 184 may also provide the computer system 180 with communication capabilities that allow the computer system 180 to have control over the valves, such as the valve 128. The communication link 184 may be configured to communicatively couple the computer system 180 to the sensors 170, 172, 174, and 176, for example to receive electrical signal outputs corresponding to pressure sensor reading being made by these sensors 170, 172, 174, and 176. The communication links 184 may be configured to communicatively couple computer system 180 to devices located at the manifold 120, for example to control the coupling and decoupling functions that may be provided by these control valves. The communication links 184 are not limited to any particular type of communication link, communication medium, or communication formats, and may include any combination of communication links, mediums, and formats determined to be appropriate for use in the wellbore environment where the pressure test may be utilized.

The computer system 180 may be configured to control or provide control commands to the controllers 160, 162, 164 of the pumps 64, 66, 84, 86, 104, and 106 to control the operation of the pumps in conjunction with control valves to automatically perform one continuous pressure cycle, or two or more discontinuous pressure cycles. In addition, the computer system 180 may be configured to receive the output signals provided by the sensors 170, 172, 174, and 176, and other sensors that may be part of the pressure test. By controlling and monitoring these devices, the computer system 180 may perform an automatic pressure testing procedure on the pumping and piping manifold 40 as illustrated and described with respect to FIG. 1, using various predefined test parameters and test values to render a leak test status.

ADDITIONAL DISCLOSURE

The following are non-limiting, specific embodiments in accordance with the present disclosure:

A first embodiment, which is a method for minimizing over pressurization during a pressure test of a fluid distribution system 10, comprises a plurality of pumping units 60 in fluid communication with a wellhead 18 via a manifold 120, the method comprising: pressurizing the fluid distribution system 10 with a fluid using an initial number of pumping units 250 to an initial predetermined pressure, and further pressurizing the fluid distribution system 10 with the fluid using a final number of pumping units 254 to a final predetermined pressure, wherein the final predetermined pressure is greater than the initial predetermined pressure, and wherein the final number of pumping units 254 is less than the initial number of pumping units 250.

A second embodiment which is the method of the first embodiment, wherein the final number of pumping units 254 is one.

A third embodiment which is the method of the first embodiment or the second embodiment, wherein each of the plurality of pumping units 60 comprises a motor 72 and at least one pump 64 and 66.

A fourth embodiment which is the method of any of the proceeding embodiments wherein the motor 72 comprises an electric motor.

A fifth embodiment which is the method of any of the proceeding embodiments wherein a final pumping unit 62 of the final number of pumping units 254 is diesel-powered.

A sixth embodiment which is the method of any of the proceeding embodiments, further comprising pressurizing with an intermediate number of pumping units 252 to an intermediate pressure.

A seventh embodiment which is the method of any of the proceeding embodiments, wherein the intermediate pressure is greater than the initial predetermined pressure and less than the final predetermined pressure.

An eighth embodiment which is the method of any of the proceeding embodiments wherein the intermediate number of pumping units 252 is less than the initial number of pumping units 250 and greater than the final number of pumping units 254.

A ninth embodiment which is the method of any of the proceeding embodiments further comprises evaluating the fluid distribution system 10 during pressurization to monitor for leakage.

A tenth embodiment which is the method of any of the proceeding embodiments further comprises, after reaching the final predetermined pressure, holding the final predetermined pressure to monitor the fluid distribution system 10 for leakage.

An eleventh embodiment which is the method of any of the proceeding embodiments wherein the plurality of pumping units 60 and the manifold 120 are comprised in a pumping and piping manifold 40, and further comprising determining whether a pressure loss based on one or more measured pressures in the pumping and piping manifold 40 is indicative of a leak.

A twelfth embodiment which is the method of any of the proceeding embodiments further comprises maintaining at least the initial predetermined pressure for a first evaluation time period and monitoring one or more measured pressures within the fluid distribution system 10 during the first evaluation time period to identify a leak associated with a decrease in pressure, and maintaining the final predetermined pressure for a second evaluation time period and monitoring one or more measured pressures within the fluid distribution system 10 during the second evaluation time period to identify a leak associated with a decrease in pressure.

A thirteenth embodiment which is the method of any of the proceeding embodiments wherein the plurality of pumping units 60 and the manifold 120 is located above a surface 20.

A fourteenth embodiment which is the method of any of the proceeding embodiments wherein each of the plurality of pumping units 60 comprises a motor 72 and at least one pump 64 and 66.

A fifteenth embodiment which is the method of any of the proceeding embodiments wherein the motor 72 comprises an electric motor.

A sixteenth embodiment which is the method of any of the proceeding embodiments wherein at least one pumping unit 62 operates continuously until a maximum pressure is reached.

A seventeenth embodiment which is the method of any of the proceeding embodiments wherein the initial number of pumping units 250 is three, the intermediate number of pumping units 252 is two, and the final number of pumping units 254 is one.

An eighteenth which is the method of any of the proceeding embodiments wherein the final number of pumping units 60 is operated continuously during the pressure test until the final pressure is obtained.

A nineteenth embodiment which is the method of any of the proceeding embodiments wherein the final number of pumping units 60 is operated discontinuously by deactivating and reactivating the final number of pumping units 60 during the pressure test until the final pressure is obtained.

A twentieth embodiment which is the method of any of the proceeding embodiments wherein time between changing between the initial number of pumping units 250 and the final number of pumping units 254 is greater than about 10 seconds.

A twenty-first embodiment which is the method of any of the proceeding embodiments wherein reduction in a number of pumping units minimizes flow and kinetic energy exerted on the pumping units 102 removed from the initial number 250 to obtain the intermediate number of pumping units 252.

A twenty-second embodiment which is the method of any of the proceeding embodiments wherein a pressure cycle is conducted on a closed system 50 by isolating the wellhead 18 from a pumping and piping manifold 40.

A twenty-third embodiment which is the method of any of the proceeding embodiments wherein the final number of pumping units 254 has been scrutinized for recent mechanical maintenance.

A twenty-fourth embodiment which is the method of any of the proceeding embodiments wherein at least one pumping unit 62, 82, and 102 is different from other pumping units of the initial number of pumping units 250.

A twenty-fifth embodiment which is the method of any of the proceeding embodiments wherein the initial predetermined pressure is about 3,000 to about 5,000 psi.

A twenty-sixth embodiment which is the method of any of the proceeding embodiments wherein the final predetermined pressure is at least about 10,000 psi.

A twenty-seventh embodiment which is the method of any of the proceeding embodiments wherein the final predetermined pressure is no more than about 30,000 psi.

A twenty-eighth embodiment which is the method of any of the proceeding embodiments wherein the final predetermined pressure is about 10,000 psi to about 14,000 psi.

A twenty-ninth embodiment which is the method of any of the proceeding embodiments wherein an intermediate group of pumping units 252 is selected from and less than the initial group of pumping units 250, and the final group of pumping units 254 is selected from and less than the intermediate group of pumping units 252.

A thirtieth embodiment which is a method of conducting a pressure test, comprises: isolating a pumping and piping manifold 40 to form a closed system 50 by closing a valve 140 upstream from a wellhead 18, wherein the pumping and piping manifold 40 comprises a plurality of pumping units 60 in fluid communication with the wellhead 18 via a manifold 120; pressuring the closed system 50 with a fluid using an initial number of pumping units 250 to an initial predetermined pressure, and further pressurizing the closed system 50 with the fluid using a final number of pumping units 254 to a final predetermined pressure, wherein the final predetermined pressure is greater than the initial predetermined pressure, and wherein the final number of pumping units 254 is less than the initial number of pumping units 250.

A thirty-first embodiment which is the method of the thirtieth embodiment wherein the final number of pumping units 254 is one.

A thirty-second embodiment which is the method of the thirtieth embodiment or the thirty-first embodiment wherein a final pumping unit 62 of the final number of pumping units 254 is diesel-powered.

A thirty-third embodiment which is the method of any of the thirtieth embodiment through thirty-second embodiment wherein the initial predetermined pressure is about 3,000 to about 5,000 psi.

A thirty-fourth embodiment which is the method of any of the thirtieth embodiment through thirty-third embodiment wherein the final predetermined pressure is at least about 10,000 psi.

A thirty-fifth embodiment which is the method of any of the thirtieth embodiment through thirty-fourth embodiment wherein the final predetermined pressure is no more than about 30,000 psi.

A thirty-sixth which is the method of any of the thirtieth embodiment through thirty-fifth embodiment wherein the final predetermined pressure is about 10,000 psi to about 14,000 psi.

A thirty-seventh embodiment which is a method for detecting a leak in a pumping and piping manifold 40 for at least one wellbore operation, comprises: performing a pressure cycle on the pumping and piping manifold 40, wherein the pressure cycle comprises: pressurizing the pumping and piping manifold 40 with a fluid to generate a predetermined pressure within the pumping and piping manifold 40, monitoring one or more measured pressures within the pumping and piping manifold 40 at one or more times during an evaluation time period beginning once a predetermined pressure with the pumping and piping manifold 40 has been reached, further increasing pressurization of the pumping and piping manifold 40 to observe an inflection point of pressure versus time after pressurizing, and determining whether a pressure loss in the pumping and piping manifold 40 indicates detection of a leak based on the one or more measured pressures.

A thirty-eighth embodiment which is the method of the thirty-seventh embodiment wherein the inflection point is observed by reducing from a first number of pumping units 250 to a lesser second number of pumping units 252, 254.

A thirty-ninth embodiment which is the method of the thirty-seventh embodiment or thirty-eighth embodiment, further comprises observing at least one or a plurality of inflection points as the number of pumping units 250 is reduced.

A fortieth embodiment which is a system 10 comprises a pumping and piping manifold 40 comprising a piping network 132 forming one or more flow paths 114, 116, 118, and 130 for containing and delivering a fluid to a wellhead 18; a plurality of pumping units 60 comprised in the pumping and piping manifold 40, the plurality of pumping units 60 configured to provide the fluid; one or more sensors 170, 172, 174, and 176 configured to monitor one or more fluid pressures within the pumping and piping manifold 40; and a controller 160, 162, or 164 configured to automatically control an operation of the plurality of pumping units 60 and to perform a single pressure testing cycle on the pumping and piping manifold 40, wherein a pressure testing cycle comprises pressurizing the pumping and piping manifold 40 to an initial predetermined pressure within the pumping and piping manifold 40 using two or more of the plurality of pumping units 60 configured in a predefined pump configuration constituting a first number of pumping units 250, further pressurizing the pumping and piping manifold 40 using a second number of pumping units 252 less than the first number of pumping units 250 to a maximum pressure with at least one pumping unit 62 of the first number of pumping units 250 operating continuously to the maximum pressure, monitoring, based on output signal from the one or more sensors 170, 172, 174, and 176, one or more measured pressures levels within the pumping and piping manifold 40 at one or more times during an evaluation time period beginning once the predetermined pressure within the pumping and piping manifold 40 has been reached, including monitoring a bleed off pressure within the pumping and piping manifold 40 over the evaluation time period as a slope of a pressure curve, and determining whether a pressure loss in the pumping and piping manifold 40 exceeds a maximum bleed off value.

A forty-first embodiment which is the system of the fortieth embodiment wherein the monitoring continues until the maximum pressure is reached.

A forty-second embodiment which is the system of the fortieth embodiment or forty-first embodiment wherein the pumping and piping manifold 40 comprises the plurality of pumping units 60 in fluid communication with the wellhead 18 via a manifold 120 and one or more lines 130.

A forty-third embodiment which is the system of any of the fortieth embodiment through forty-second embodiment wherein at least a portion of the pumping and piping manifold 40 is located above a surface 20.

A forty-fourth embodiment which is the system of any of the fortieth embodiment through forty-third embodiment wherein each of the plurality of pumping units 60 comprises a motor 72 and at least one pump 64 and 66.

A forty-fifth embodiment which is the system of any of the fortieth embodiment through forty-third embodiment wherein the motor 72 comprises an electric motor.

A forty-sixth embodiment which is an oil and gas platform 10 comprises the system 10 of any of the fortieth embodiment through forty-fifth embodiment.

A forty-seventh embodiment which is a method of pressure testing a manifold 120 in fluid communication with a wellhead 18, comprises: starting pumping of fluid by first number of pumping units 250 in fluid communication with the manifold 120 to pressurize the manifold 120 to a first predetermined pressure; upon reaching the first predetermined pressure, halting pumping of fluid by one or more of the first number of pumping unit 250; continuing pumping of fluid with a second number of pumping units 252 or 254 that is less than the first number of pumping units 250 (e.g., a single pump driven by an electric motor) to pressurize the manifold 120 to a second predetermined pressure; and upon reaching the second predetermined pressure, halting pumping of fluid by the second number of pumping units 252 or 254.

A forty-eighth embodiment which is a method of the forty-seventh embodiment wherein the step of continuing pumping of fluid further comprises as pressure in the piping manifold 120 approaches the second predetermined pressure (e.g., is within about 1000 psi, about 900 psi, about 800 psi, about 700 psi, about 600 psi, 500 psi, about 400 psi, about 300 psi, about 200 psi, about 100 psi, about 50 psi, about 10 psi, or about 1 psi thereof) reducing a pumping rate of the second number of pumps 252 or 254 (e.g., by reducing a variable drive electric motor 92 driving a pump 84).

A forty-ninth embodiment which is a method of the forty-seventh embodiment or forty-eighth embodiment wherein pressure in the manifold 120 does not exceed the second predetermined pressure (by more than about 1000 psi, about 500 psi, about 100 psi, about 50 psi, about 40 psi, about 30 psi, about 20 psi, about 10 psi, about 9 psi, about 8 psi, about 7 psi, about 6 psi, about 5 psi, about 4 psi, about 3 psi, about 2 psi, about 1 psi, about 0.5 psi, about 0.1 psi, or about 0 psi) before the halting pumping of fluid by the second number of pumps 252 or 254 (e.g., there is minimal or no overshoot of the second predetermined pressure), which may be associated with an over pressurization threshold of the manifold 120 and equipment in fluid communication with the manifold 120.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. When a feature is described as "optional," both embodiments with this feature and embodiments without this feature are disclosed. Similarly, the present disclosure contemplates embodiments where this feature is required and embodiments where this feature is specifically excluded. Both alternatives are intended to be within the scope of the claim. Use of broader terms such as includes, includes, having, etc. should be understood to provide support for narrower terms such as consisting of, consisting essentially of, included substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure.

What is claimed is:

1. A method for minimizing over pressurization during a pressure test of a fluid distribution system comprising a plurality of pumping units in fluid communication with a wellhead via a manifold, the method comprising:

pressurizing the fluid distribution system with a fluid using an initial number of pumping units to an initial predetermined pressure; and further pressurizing the fluid distribution system with the fluid using a final number of pumping units to a final predetermined pressure, wherein the final predetermined pressure is greater than the initial predetermined pressure, wherein the final number of pumping units is less than the initial number of pumping units, wherein the final number of pumping units is operated continuously, from pressuring with the initial number of pumping units to the initial predetermined pressure, until the final predetermined pressure is obtained, and wherein a subset of the initial number of pumping units is no longer pumping at the final predetermined pressure and the subset is not subject to a backlash force produced by a pressurized fluid from damaging one or more drive shafts of the subset.

2. The method of claim 1, wherein the final number of pumping units is one.

3. The method of claim 2, wherein a final pumping unit of the final number of pumping units is electrically driven and has been subjected to maintenance to improve mechanical reliability, wherein the final pumping unit is subjected to the final predetermined pressure for ensuring proper seals.

4. The method of claim 1, wherein each of the plurality of pumping units comprises a motor and at least one pump.

5. The method of claim 4, wherein the motor comprises an electric motor.

6. The method of claim 1, further comprising pressurizing with an intermediate number of pumping units to an intermediate pressure.

7. The method of claim 6, wherein the intermediate pressure is greater than the initial predetermined pressure and less than the final predetermined pressure.

8. The method of claim 6, wherein the intermediate number of pumping units is less than the initial number of pumping units and greater than the final number of pumping units.

9. The method of claim 8, wherein the intermediate number of pumping units is selected from and less than the initial number of pumping units, and the final number of pumping units is selected from and less than the intermediate number of pumping units.

10. The method of claim 6, wherein at least one pumping unit of the intermediate number of pumping units is different from the pumping units of the initial number of pumping units, and the at least one pumping unit is different by comprising a clutch or a different power source.

11. The method of claim 1, further comprising evaluating the fluid distribution system during pressurization to monitor for leakage.

12. The method of claim 11, further comprising, after reaching the final predetermined pressure, holding the final predetermined pressure to monitor the fluid distribution system for leakage.

13. The method of claim 1, wherein the plurality of pumping units and the manifold are comprised in a pumping and piping manifold coupled to the wellhead and isolated from fluid flow through the wellhead, and further comprising:

determining whether a pressure loss based on one or more measured pressures in the pumping and piping manifold is indicative of a leak.

14. The method of claim 1, further comprising (i) maintaining the initial predetermined pressure for a first evaluation time period and monitoring one or more measured pressures within the fluid distribution system during the first evaluation time period to identify a leak associated with a decrease in pressure, (ii) maintaining the final predetermined pressure for a second evaluation time period and monitoring one or more measured pressures within the fluid distribution system during the second evaluation time period to identify a leak associated with a decrease in pressure, or (iii) both (i) and (ii).

15. The method of claim 1, wherein time between starting the pressure test with the initial number of pumping units and changing to the final number of pumping units is greater than 10 seconds and less than 60 seconds.

16. The method of claim 1, wherein the initial predetermined pressure is 3,000 to 5,000 psi and the final predetermined pressure is in a range of from 10,000-20,000 psi.

17. A method of conducting a pressure test, comprising:

isolating a pumping and piping system coupled to a wellhead to form a closed system by closing a valve upstream from the wellhead, wherein the pumping and piping system comprises a plurality of pumping units in fluid communication with the wellhead via piping and a manifold;

pressuring the closed system with a fluid using an initial number of pumping units to an initial predetermined pressure; and further pressurizing the closed system with the fluid using a final number of pumping units to a final predetermined pressure, wherein the final predetermined pressure is greater than the initial predetermined pressure, wherein the final number of pumping units is less than the initial number of pumping units, wherein the final number of pumping units is operated continuously, from pressuring with the initial number of pumping units to the initial predetermined pressure, until the final predetermined pressure is obtained, and wherein a subset of the initial number of pumping units is no longer pumping at the final predetermined pressure and the subset is not subject to a backlash force produced by a pressurized fluid from damaging one or more drive shafts of the subset.

18. The method of claim 17, further comprising pressurizing with an intermediate number of pumping units to an intermediate pressure.

19. The method of claim 18, wherein at least one pumping unit of the intermediate number of pumping units is different from the pumping units of the initial number of pumping units, and the at least one pumping unit is different by comprising a clutch or a different power source.

20. A method of pressure testing a manifold and piping coupled to a wellhead and isolated from fluid flow through the wellhead, comprising:

starting pumping of a fluid by first number of pumping units in fluid communication with the manifold and piping to pressurize the manifold and piping to a first predetermined pressure;

upon reaching the first predetermined pressure, halting pumping of fluid by one or more of the first number of pumping units;

continuing pumping of the fluid with a second number of pumping units that is less than the first number of pumping units to pressurize the manifold and piping to a second predetermined pressure; and upon reaching the second predetermined pressure, halting pumping of the fluid by the second number of pumping units, wherein at least one pumping unit of the second number of pumping units is different from the pumping units of the first number of pumping units, and the at least one pumping unit is different by comprising a clutch, and wherein one or more drive shafts of the at least one pumping unit of the second number of pumping units no longer pumping at the second predetermined pressure is not subject to a backlash force produced by a pressurized fluid by disengaging the clutch prior to stopping pumping at the second predetermined pressure.

* * * * *